US011383954B2

(12) United States Patent
Stanley et al.

(10) Patent No.: US 11,383,954 B2
(45) Date of Patent: Jul. 12, 2022

(54) SUPER GROUP ARCHITECTURE WITH ADVANCED BUILDING WIDE DISPATCHING LOGIC

(71) Applicant: Otis Elevator Company, Farmington, CT (US)

(72) Inventors: Jannah A. Stanley, Portland, CT (US); Daniel S. Williams, Southington, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 1052 days.

(21) Appl. No.: 16/018,532

(22) Filed: Jun. 26, 2018

(65) Prior Publication Data

US 2019/0389688 A1 Dec. 26, 2019

(51) Int. Cl.

| | |
|---|---|
| ***B66B 1/24*** | (2006.01) |
| ***B66B 1/28*** | (2006.01) |
| ***B66B 1/34*** | (2006.01) |

(52) U.S. Cl.

CPC ..... *B66B 1/2458* (2013.01); *B66B 1/28* (2013.01); *B66B 1/3446* (2013.01); *B66B 2201/104* (2013.01); *B66B 2201/233* (2013.01)

(58) Field of Classification Search

CPC ..... B66B 1/2458; B66B 1/28; B66B 1/3446; B66B 2201/104; B66B 2201/233; B66B 1/18; B66B 2201/211

See application file for complete search history.

(56) References Cited

U.S. PATENT DOCUMENTS

| | | | | |
|---|---|---|---|---|
| 4,991,694 | A | 2/1991 | Friedli | |
| 5,065,846 | A | 11/1991 | Schroder | |
| 5,168,136 | A | 12/1992 | Thangavelu et al. | |
| 5,427,206 | A * | 6/1995 | Powell | B66B 1/18 187/382 |
| 5,612,519 | A | 3/1997 | Chenais | |
| 5,625,176 | A * | 4/1997 | Davis | B66B 1/2458 187/393 |

(Continued)

FOREIGN PATENT DOCUMENTS

| | | | |
|---|---|---|---|
| CN | 101403891 | A | 4/2009 |
| CN | 101837911 | A | 9/2010 |

(Continued)

OTHER PUBLICATIONS

EP Search Report dated Oct. 25, 2019; Application No. 19182634.6-1017; 9 pages.

(Continued)

*Primary Examiner* — Jeffrey Donels
(74) *Attorney, Agent, or Firm* — Cantor Colburn LLP

(57) ABSTRACT

A method of operating a building elevator system having a plurality of elevator systems organized into multiple elevator groups including: receiving an elevator call from a destination entry device in communication with the building elevator system; obtaining a favorability score from each of the multiple elevator groups of the building elevator system; determining an elevator group of the multiple elevator groups with the highest favorability score; and routing the elevator call to the elevator group of the multiple elevator groups with the highest favorability score.

20 Claims, 3 Drawing Sheets

(56) References Cited

U.S. PATENT DOCUMENTS

| | | | | |
|---|---|---|---|---|
| 7,117,980 | B2 * | 10/2006 | Wyss | B66B 1/18 187/383 |
| 7,128,190 | B2 * | 10/2006 | Kostka | B66B 1/20 187/383 |
| 7,328,775 | B2 * | 2/2008 | Zaharia | B66B 1/18 187/391 |
| 9,296,588 | B2 * | 3/2016 | Christy | B66B 1/06 |
| 10,099,892 | B2 * | 10/2018 | Suihkonen | B66B 1/2458 |
| 2002/0129994 | A1 | 9/2002 | Kostka et al. | |
| 2003/0000776 | A1 | 1/2003 | Kostka | |
| 2008/0006485 | A1 | 1/2008 | Kocher et al. | |
| 2009/0283368 | A1 | 11/2009 | Yoshikawa et al. | |
| 2010/0282543 | A1 | 11/2010 | Hsu et al. | |
| 2012/0325589 | A1 * | 12/2012 | Christy | B66B 1/2408 187/247 |
| 2013/0168190 | A1 | 7/2013 | Christy et al. | |
| 2015/0096843 | A1 | 4/2015 | Siddiqui et al. | |
| 2017/0291795 | A1 | 10/2017 | Scoville et al. | |
| 2017/0313546 | A1 | 11/2017 | King | |
| 2019/0382236 | A1 * | 12/2019 | Halingale | H04W 12/08 |
| 2020/0031615 | A1 * | 1/2020 | Hsu | B66B 1/24 |

FOREIGN PATENT DOCUMENTS

| | | | |
|---|---|---|---|
| CN | 101983169 | A | 3/2011 |
| CN | 102762475 | A | 10/2012 |
| CN | 102897613 | A | 1/2013 |
| CN | 103130050 | A | 6/2013 |
| CN | 10429569 | A | 12/2014 |
| CN | 104291170 | A | 1/2015 |
| CN | 107235392 | A | 10/2017 |
| EP | 1767484 | A1 | 3/2007 |
| JP | 2014001037 | A | 1/2014 |
| WO | 2009132698 | A1 | 11/2009 |
| WO | 2011106010 | A1 | 9/2011 |

OTHER PUBLICATIONS

First Chinese Office Action for Application No. 201910554367.0; Office Action dated Apr. 27, 2021; Office Action; 11 pages.

* cited by examiner

SUPER GROUP ARCHITECTURE WITH ADVANCED BUILDING WIDE DISPATCHING LOGIC

BACKGROUND

The subject matter disclosed herein relates generally to the field of elevator systems, and specifically to a method and apparatus for coordinating the operation of multiple elevator cars.

Commonly, elevator cars are organized into elevator groups serving range of landings of a building rather than each elevator car serving the overall length of an elevator shaft to service every floor of a building. Once established, range of landings typically remain unchanged due to physical constraints in the elevator system. In conventional elevator systems, elevator calls may be served by elevator cars in multiple different groups, however the decision of which group would serve the elevator call is based on group wide operating conditions and not on the elevator call destination, which may lead to a non-optimal elevator car being sent to serve the elevator call.

BRIEF SUMMARY

According to an embodiment, a method of operating a building elevator system having a plurality of elevator systems organized into multiple elevator groups is provided. The method including: receiving an elevator call from a destination entry device in communication with the building elevator system; obtaining a favorability score from each of the multiple elevator groups of the building elevator system; determining an elevator group of the multiple elevator groups with the highest favorability score; and routing the elevator call to the elevator group of the multiple elevator groups with the highest favorability score.

In addition to one or more of the features described herein, or as an alternative, further embodiments may include: obtaining a best elevator car of the elevator group of the multiple elevator groups with the highest favorability score to answer the elevator call.

In addition to one or more of the features described herein, or as an alternative, further embodiments may include that a dispatcher of the elevator group of the multiple elevator groups with the highest favorability score is configured to determine the best elevator car of the elevator group of the multiple elevator groups with the highest favorability score to answer the elevator call.

In addition to one or more of the features described herein, or as an alternative, further embodiments may include that obtaining a favorability score from multiple elevator groups of the building elevator system further comprises: transmitting to a dispatcher of each elevator group a favorability score query in response to the elevator call; and receiving a favorability score from each elevator group in response the favorability score query and the elevator call.

In addition to one or more of the features described herein, or as an alternative, further embodiments may include that obtaining a favorability score from multiple elevator groups of the building elevator system further comprises: continuously requesting a favorability score query to a dispatch of each elevator group of the multiple elevator groups; receiving potential favorability scores from each elevator group for potential elevator calls; and determining a favorability score from the potential favorability scores in response to the elevator call.

In addition to one or more of the features described herein, or as an alternative, further embodiments may include: displaying the best elevator car on the destination entry device.

In addition to one or more of the features described herein, or as an alternative, further embodiments may include that the multiple elevator groups comprises a first elevator group serving a first range of landings and a second elevator group serving a second range of landings, wherein the second range of landings includes at least one landing not included in the first range of landings.

In addition to one or more of the features described herein, or as an alternative, further embodiments may include that the multiple elevator groups further comprises a third elevator group serving a third range of landings, wherein the third range of landings includes at least one landing included in the first range of landings and at least one landing included in the second range of landings.

In addition to one or more of the features described herein, or as an alternative, further embodiments may include: obtaining a best elevator car of the elevator group of the multiple elevator groups with the highest favorability score to answer the elevator call.

In addition to one or more of the features described herein, or as an alternative, further embodiments may include that a dispatcher of the elevator group of the multiple elevator groups with the highest favorability score is configured to determine the best elevator car of the elevator group of the multiple elevator groups with the highest favorability score to answer the elevator call.

According to another embodiment, a building elevator system having a plurality of elevator systems organized into multiple elevator groups is provided. The building elevator system including: a processor; a memory comprising computer-executable instructions that, when executed by the processor, cause the processor to perform operations, the operations comprising: receiving an elevator call from a destination entry device in communication with the building elevator system; obtaining a favorability score from each of the multiple elevator groups of the building elevator system; determining an elevator group of the multiple elevator groups with the highest favorability score; and routing the elevator call to the elevator group of the multiple elevator groups with the highest favorability score.

In addition to one or more of the features described herein, or as an alternative, further embodiments may include that the operations further comprise: obtaining a best elevator car of the elevator group of the multiple elevator groups with the highest favorability score to answer the elevator call.

In addition to one or more of the features described herein, or as an alternative, further embodiments may include that a dispatcher of the elevator group of the multiple elevator groups with the highest favorability score is configured to determine the best elevator car of the elevator group of the multiple elevator groups with the highest favorability score to answer the elevator call.

In addition to one or more of the features described herein, or as an alternative, further embodiments may include that obtaining a favorability score from multiple elevator groups of the building elevator system further comprises: transmitting to a dispatcher of each elevator group a favorability score query in response to the elevator call; and receiving a favorability score from each elevator group in response the favorability score query and the elevator call.

In addition to one or more of the features described herein, or as an alternative, further embodiments may include that obtaining a favorability score from multiple elevator groups of the building elevator system further comprises: continuously requesting a favorability score query to a dispatch of each elevator group of the multiple elevator groups; receiving potential favorability scores from each elevator group for potential elevator calls; and determining a favorability score from the potential favorability scores in response to the elevator call.

In addition to one or more of the features described herein, or as an alternative, further embodiments may include that the operations further comprise: displaying the best elevator car on the destination entry device.

In addition to one or more of the features described herein, or as an alternative, further embodiments may include that the multiple elevator groups comprises a first elevator group serving a first range of landings and a second elevator group serving a second range of landings, wherein the second range of landings includes at least one landing not included in the first range of landings.

In addition to one or more of the features described herein, or as an alternative, further embodiments may include that the multiple elevator groups further comprises a third elevator group serving a third range of landings, wherein the third range of landings includes at least one landing included in the first range of landings and at least one landing included in the second range of landings.

In addition to one or more of the features described herein, or as an alternative, further embodiments may include that the operations further comprise: obtaining a best elevator car of the elevator group of the multiple elevator groups with the highest favorability score to answer the elevator call.

In addition to one or more of the features described herein, or as an alternative, further embodiments may include that a dispatcher of the elevator group of the multiple elevator groups with the highest favorability score is configured to determine the best elevator car of the elevator group of the multiple elevator groups with the highest favorability score to answer the elevator call.

Technical effects of embodiments of the present disclosure include organizing elevator systems into groups serving a range of landings and determining the optimal elevator car and elevator group to serve the elevator call in response to the destination of the elevator call.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
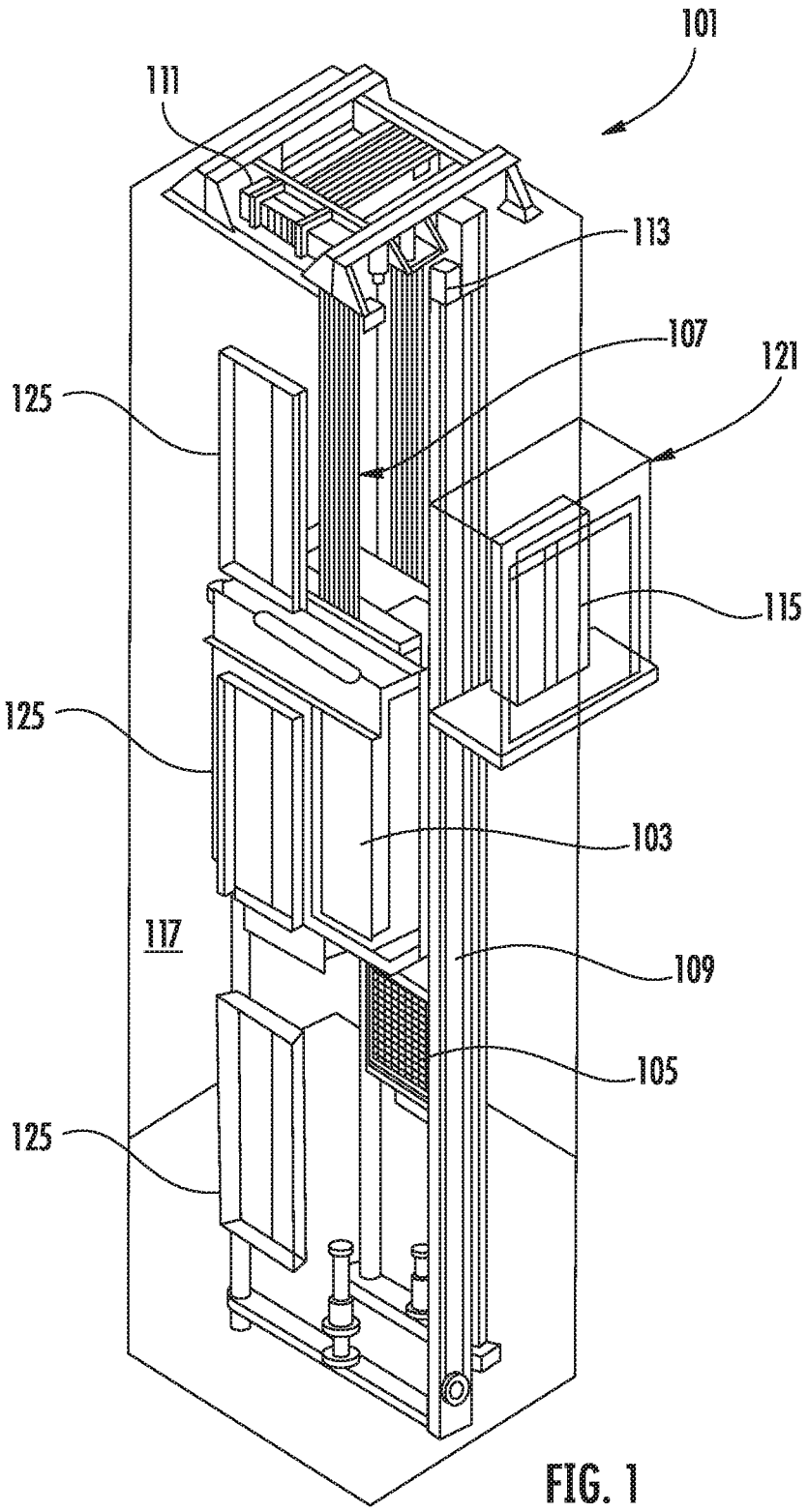
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator shaft 117, such as on a support or guide rail, and may be configured to provide position signals related to a position of the elevator car 103 within the elevator shaft 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator shaft 117.

Although shown and described with a roping system including tension member 107, elevator systems that employ other methods and mechanisms of moving an elevator car within an elevator shaft may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

Figure 2:
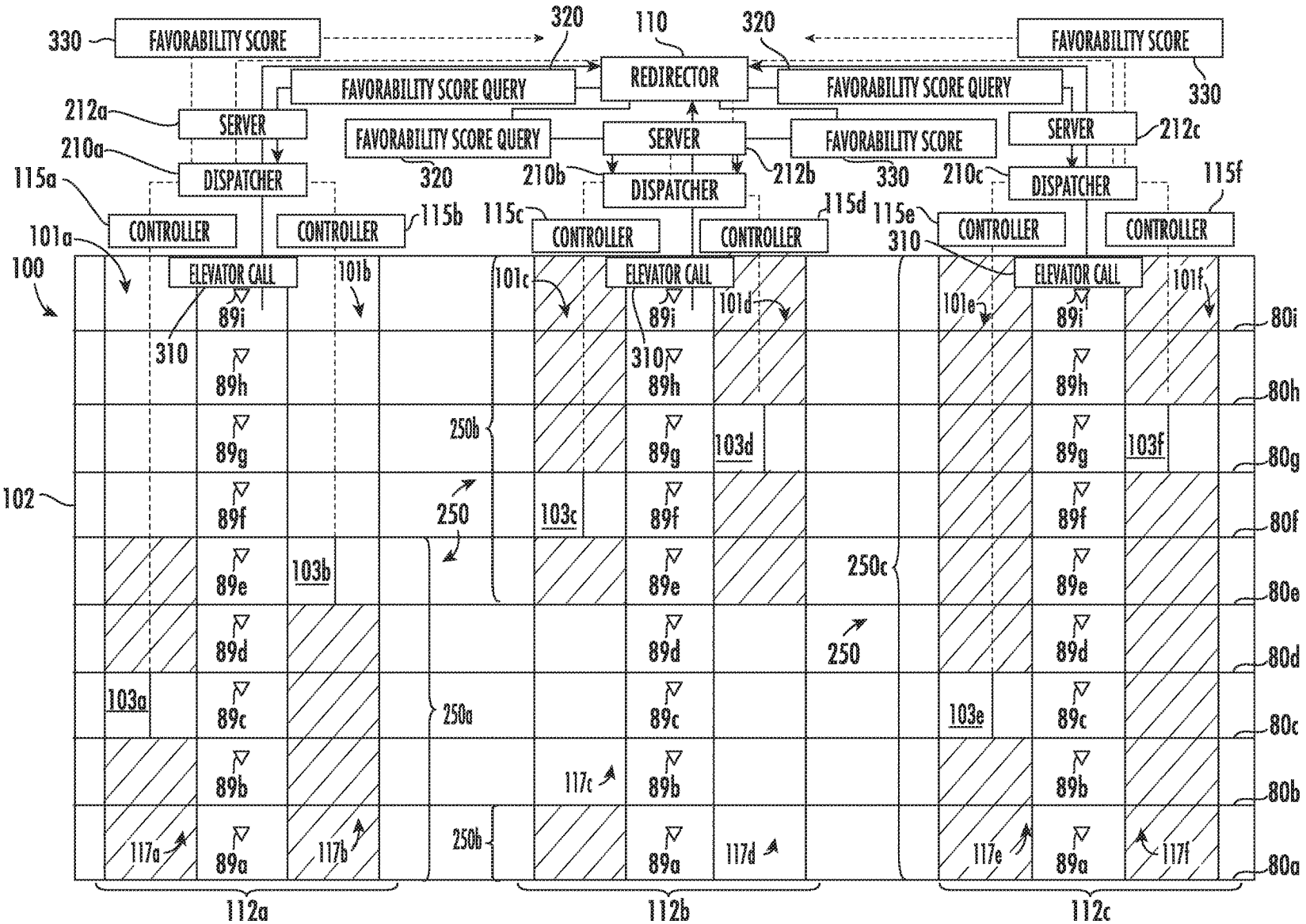
FIG. 2 illustrates a schematic view of a building elevator system, in accordance with an embodiment of the disclosure.

Referring now to FIG. 2 with continued reference to FIG. 1. As seen in FIG. 2, a building elevator system 100 within a building 102 may include multiple different individual elevator systems 101*a*-101*f* organized in elevator groups 112*a*-112*c*. It is understood that while six elevator systems 101*a*-101*f* are utilized for exemplary illustration, embodiments disclosed herein may be applied to building elevator systems 100 having two or more elevator systems 101. It is also understood that while nine floors 80*a*-80*i* are utilized for exemplary illustration, embodiments disclosed herein may be applied to building elevator systems 100 having any number of floors.

Further, the elevator systems 101*a*-101*f* illustrated in FIG. 2 is organized in to three elevator groups 112*a*-112*c* for ease of explanation but it is understood that the elevator systems 101*a*-101*f* organized into one or more elevator groups. Each elevator group 112*a*-112*c* may contain one or more elevator systems 101. During normal operation, a first elevator group 112*a* serves a first range of landings 250*a* (i.e., a lower range of landing) comprising floors 80*a*-80*e*. During normal operation, a second elevator group 112*b* serves a second range of landings 250*b* (i.e., a higher range of landings) comprising floors 80*e*-80*i* and floor 80*a*. During normal operation, a third elevator group 112*c* serves a third range of landings 250*c* (i.e., an entire building range of landings) comprising floors 80*a*-80*i*. It is understood that while each elevator group 112*a*-112*c* serves only one range of landings 250 for exemplary illustration, embodiments disclosed herein may include elevator groups having multiple elevator systems where each elevator system in a single elevator group serves a different range of landings.

Each floor 80*a*-80*i* in the building 102 of FIG. 2 may have a destination entry device 89*a*-89*i*. The elevator destination entry device 89*a*-89*i* sends an elevator call 310 to the redirector 110 including the source of the elevator call 310 and the destination of the elevator call 310. The destination entry device 89*a*-89*i* may serve one or more elevator groups 112*a*-112*c*. The destination entry device 89*a*-89*i* may be a push button and/or a touch screen and may be activated manually or automatically. For example, the elevator call 310 may be sent by an individual entering the elevator call 310 via the destination entry device 89*a*-89*i*. The destination entry device 89*a*-89*i* may also be activated to send an elevator call 310 by voice recognition or a passenger detection mechanism in the hallway, such as, for example a weight sensing device, a visual recognition device, and a laser detection device. The destination entry device 89*a*-89*i* may be activated to send an elevator call 310 through an automatic elevator call system that automatically initiates an elevator call 310 when an individual is determined to be moving towards the elevator system in order to call an elevator or when an individual is scheduled to activate the destination entry device 89*a*-89*i*. The destination entry device 89*a*-89*i* may also be a mobile device configured to transmit and elevator call 310. The mobile device may be a smart phone, smart watch, laptop, or any other mobile device known to one of skill in the art.

The redirector 110 is in communication with the controller 115*a*-115*f* of each elevator system 101*a*-101*f* through a dispatcher 210*a*-210*c* and a server 212*a*-212*c*, as shown in FIG. 2. The dispatchers 210*a*-210*c* may be a 'group' software that is configured to select the best elevator car 103 within the range of landings 250 assigned to the dispatcher 210*a*-210*c*. The servers 212*a*-212*c* are similar to a redirector 110 being that the servers 212*a*-212*c* manage the destination entry devices 89*a*-89*i* related to a particular group 112*a*-112*c* (e.g., the redirector 110 interfaces with destination entry devices 89*a*-89*i* that are shared between groups 112*a*-112*c*). In an embodiment, the servers 212*a*-212*c* may be configured to operate as a pass through between the redirector 110 and the dispatcher 210*a*-210*c* associated with the server 212*a*-212*c*.

The controllers 115*a*-115*f* can be combined, local, remote, cloud, etc. The redirector 110 is configured to control and coordinate operation of multiple elevator systems 101*a*-101*f*. The redirector 110 may be an electronic controller including a processor and an associated memory comprising computer-executable instructions that, when executed by the processor, cause the processor to perform various operations. The processor may be, but is not limited to, a single-processor or multi-processor system of any of a wide array of possible architectures, including field programmable gate array (FPGA), central processing unit (CPU), application specific integrated circuits (ASIC), digital signal processor (DSP) or graphics processing unit (GPU) hardware arranged homogenously or heterogeneously. The memory may be but is not limited to a random access memory (RAM), read only memory (ROM), or other electronic, optical, magnetic or any other computer readable medium.

The redirector 110 is in communication with each of the elevator destination entry devices 89*a*-89*i* of the building elevator system 100, which are shared by more than one group 112*a*-112*c*. The redirector 110 is configured to receive each elevator call 310 transmitted from the elevator destination entry devices 89*a*-89*i*. The redirector 110 is configured to manage the elevators calls 310 coming in from each destination entry device 89*a*-89*i* and allow any elevator systems 101 to respond to elevator calls 310. Conventional destination entry devices 89*a*-89*i* may be assigned to specific elevator groups 112*a*-112*c* however, the redirector 110 of the present disclosure is configured to allow destination entry devices 89*a*-89*i* to transmit elevator calls 310 to any group 112*a*-112*c*.

When an elevator call 310 is received from any of the destination entry devices 89*a*-89*i*, which are shared by more than one group 112*a*-112*c*, the redirector 110 is configured to obtain a favorability score 330 of each elevator group 112*a*-112*c* for the specific elevator call 310. In an embodiment, the redirector 110 may obtain the favorability scores 330 by transmitting a favorability score query 320 to a dispatcher 210*a*-210*c* of each elevator group 112*a*-112*c* in response to each elevator call 310 received. The favorability score query 320 may be transmitted from the redirector 110 to the dispatcher 210*a*-210*c* through the server 212*a*-212*c* of each elevator group 112*a*-112*c*. In another embodiment, the redirector 110 may obtain the favorability scores 330 by continuously collecting data from all elevator groups 112*a*-112*c* regarding the favorability score 330 for all possible elevator calls 310 (each elevator call including a destination request) for each elevator group 112*a*-112*c*. A favorability score 330 represents how well the best elevator car for this elevator call 310 in the elevator group could serve the demand. A favorability score 330 can consist of multiple pieces of data (i.e., variables) that can contribute to the favorability score 330, which may include but is not limited to a spare capacity of a group 112*a*-112*c* (i.e., how busy the group currently is), the source floor's waiting time, if there is an elevator car 103 available to serve this elevator call 310 immediately, if the source/destination elevator call 130 is already assigned to an elevator car 103 in this group (e.g., coincident call), if the destination is part of a group of destinations already assigned to this group (e.g., sectoring), building management preferences (e.g., time of day, external sensors detecting crowds), a current position of the elevator car 103, current commitments of the elevator car 103, a number of stops each passenger assigned to the elevator car 103 will make prior to reaching their destination, how long it will take the elevator car 103 to serve the elevator call 310, and the impact of adding this elevator call 310 to this elevator car 103 on the other elevator call 310 already assigned to the wait time of the elevator car 103 Once the favorability scores 330 from each elevator group 112*a*-112*c* are obtained, the redirector 110 will route the elevator call 310 to the elevator group 112*a*-112*c* with the best favorability score 330 and the elevator group 112*a*-112*c* will return to the redirector 110 which elevator car 103 in the elevator group 112*a*-112*c* is assigned to the request so that the redirector can display this information for the passenger. The information may be displayed on the destination entry device 89*a*-89*i*.

Figure 3:
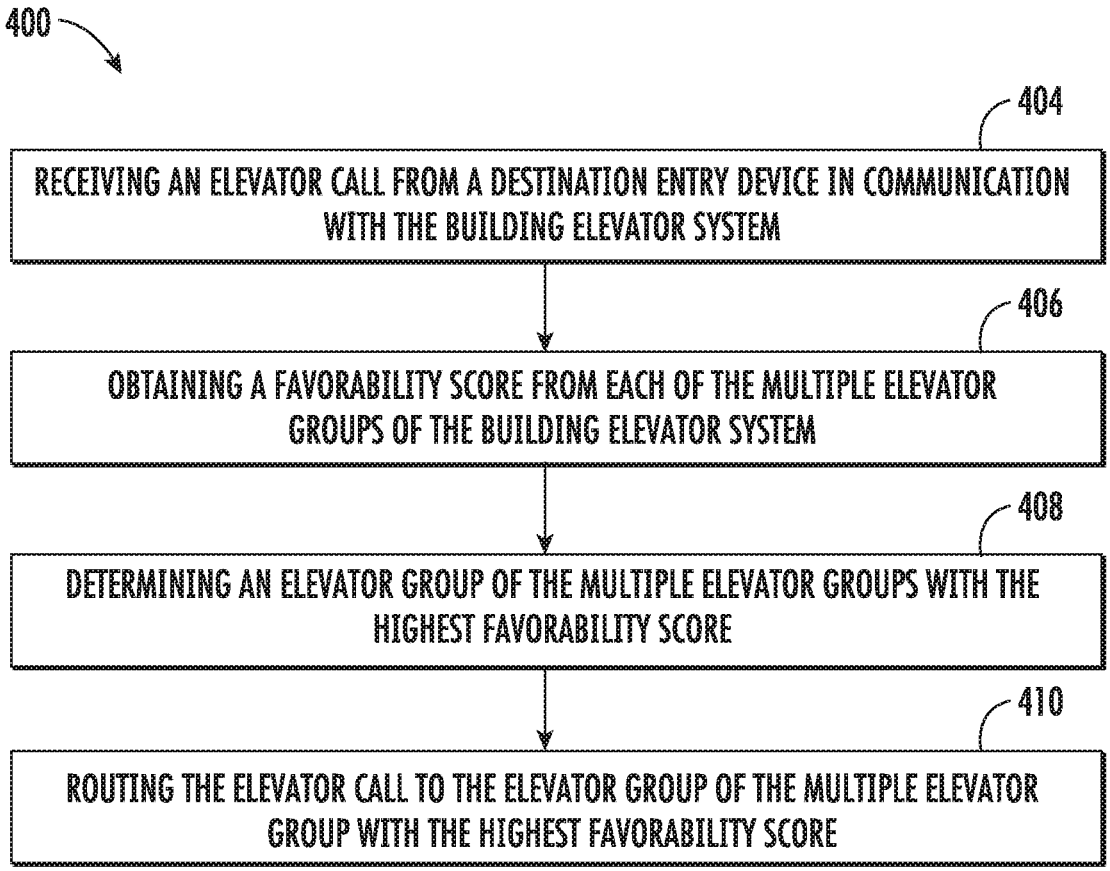
FIG. 3 is a flow chart of method of operating a building elevator system, in accordance with an embodiment of the disclosure.

Referring now to FIG. 3, while referencing components of FIGS. 1 and 2. FIG. 3 shows a flow chart of method 400 of operating a building elevator system 100 having a plurality of elevator systems 101*a*-101*f* organized into multiple elevator groups 112*a*-112*c*, in accordance with an embodiment of the disclosure. In an embodiment, the method 400 may be performed by the redirector 110. At block 404, an elevator call 310 is received from a destination entry device 89*a*-89*i* in communication with the building elevator system 100.

At block 406, a favorability score 330 is obtained from each of the multiple elevator groups 112*a*-112*c* of the building elevator system 100. At block 408, an elevator group of the multiple elevator groups 112*a*-112*c* with the highest favorability score 330 is obtained. For example, the elevator group of the multiple elevator groups 112*a*-112*c* with the highest favorability score 330 may be the second elevator group 112*b*. It is understood that the elevator group 112*a*-112*c* with the highest favorability score 330 may vary depending on the elevator call 310 and is not limited to the second elevator group 112*b* but may also be the first elevator group 112*a* or the third elevator group 112*c*.

The highest favorability score 330 may be obtained by: transmitting to a dispatcher 210*a*-210*c* of each elevator group 112*a*-112*c* a favorability score query 320 in response to the elevator call 320; and receiving a favorability score 330 from each elevator group 112*a*-112*c* in response the favorability score query 320 and the elevator call 310. The highest favorability score 330 may also be obtained by: continuously requesting a favorability score query 320 to a dispatch 210*a*-210*c* of each elevator group 112*a*-112*c* of the multiple elevator groups 112*a*-112*c*; receiving potential favorability scores 330 from each elevator group 112*a*-112*c* for potential elevator calls 310; and determining a favorability score 330 from the potential favorability scores in response to the elevator call. The potential favorability scores are continuously trying to predict what a favorability score 330 may be for different elevator calls 310 that include different destinations.

At block 410, the elevator call 310 is routed to the elevator group with the highest favorability score 330. Once the elevator call 310 is routed to the elevator group with the highest favorability score 330, a best elevator car 103 of the elevator group with the highest favorability score 330 to answer the elevator call 310 may be obtained by the redirector 110. A dispatcher 210*b* of the elevator group with the highest favorability score 330 is configured to determine the best elevator car 103 of the elevator group with the highest favorability score 330 to answer the elevator call 310. The method 400 may further comprise that the best elevator car 103 may be displayed on the destination entry device 89*a*-89*i* so that the passenger may see which elevator car 103*a*-103*f* of each group 112*a*-112*c* they will be boarding.

While the above description has described the flow process of FIG. 3 in a particular order, it should be appreciated that unless otherwise specifically required in the attached claims that the ordering of the steps may be varied.

As described above, embodiments can be in the form of processor-implemented processes and devices for practicing those processes, such as processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes a device for practicing the embodiments. When implemented on a general-purpose microprocessor, the computer program code segments configure the microprocessor to create specific logic circuits.

The term "about" is intended to include the degree of error associated with measurement of the particular quantity and/or manufacturing tolerances based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A method of operating a building elevator system having a plurality of elevator systems organized into multiple elevator groups, the method comprising:

receiving an elevator call from a destination entry device in communication with the building elevator system;

obtaining a favorability score from each of the multiple elevator groups of the building elevator system;

determining an elevator group of the multiple elevator groups with the highest favorability score; and routing the elevator call to the elevator group of the multiple elevator groups with the highest favorability score, wherein obtaining a favorability score from multiple elevator groups of the building elevator system further comprises:

continuously requesting a favorability score query to a dispatch of each elevator group of the multiple elevator groups;

receiving potential favorability scores from each elevator group for potential elevator calls; and determining a favorability score from the potential favorability scores in response to the elevator call.

2. The method of claim 1, further comprising:

obtaining a best elevator car of the elevator group of the multiple elevator groups with the highest favorability score to answer the elevator call.

3. The method of claim 2, wherein a dispatcher of the elevator group of the multiple elevator groups with the highest favorability score is configured to determine the best elevator car of the elevator group of the multiple elevator groups with the highest favorability score to answer the elevator call.

4. The method of claim 1, wherein obtaining a favorability score from multiple elevator groups of the building elevator system further comprises:

transmitting to a dispatcher of each elevator group a favorability score query in response to the elevator call; and receiving a favorability score from each elevator group in response the favorability score query and the elevator call.

5. The method of claim 2, further comprising:

displaying the best elevator car on the destination entry device.

6. The method of claim 1, wherein the multiple elevator groups comprises a first elevator group serving a first range of landings and a second elevator group serving a second range of landings, wherein the second range of landings includes at least one landing not included in the first range of landings.

7. The method of claim 6, wherein the multiple elevator groups further comprises a third elevator group serving a third range of landings, wherein the third range of landings includes at least one landing included in the first range of landings and at least one landing included in the second range of landings.

8. The method of claim 7, further comprising:

obtaining a best elevator car of the elevator group of the multiple elevator groups with the highest favorability score to answer the elevator call.

9. The method of claim 8, wherein a dispatcher of the elevator group of the multiple elevator groups with the highest favorability score is configured to determine the best elevator car of the elevator group of the multiple elevator groups with the highest favorability score to answer the elevator call.

10. The method of claim 1, wherein the favorability score consists of at least one of:

whether there is an elevator car available to serve this elevator call immediately;

whether a source or a destination of the elevator call is already assigned to an elevator car in the elevator group; or whether the destination is part of a group of destinations already assigned to this group.

11. The method of claim 1, wherein the favorability score consists of at least one of:

a current position of the elevator car;

a number of stops each passenger assigned to the elevator car will make prior to reaching their destination;

how long it will take the elevator car to serve the elevator call; or the impact of adding this elevator call to this elevator car on the other elevator call already assigned to the wait time of the elevator car.

12. A building elevator system having a plurality of elevator systems organized into multiple elevator groups, the building elevator system comprising:

a processor;

a memory comprising computer-executable instructions that, when executed by the processor, cause the processor to perform operations, the operations comprising:

receiving an elevator call from a destination entry device in communication with the building elevator system;

obtaining a favorability score from each of the multiple elevator groups of the building elevator system;

determining an elevator group of the multiple elevator groups with the highest favorability score; and routing the elevator call to the elevator group of the multiple elevator groups with the highest favorability score, wherein obtaining a favorability score from multiple elevator groups of the building elevator system further comprises:

continuously requesting a favorability score query to a dispatch of each elevator group of the multiple elevator groups;

receiving potential favorability scores from each elevator group for potential elevator calls; and determining a favorability score from the potential favorability scores in response to the elevator call.

13. The building elevator system of claim 12, wherein the operations further comprise:

obtaining a best elevator car of the elevator group of the multiple elevator groups with the highest favorability score to answer the elevator call.

14. The building elevator system of claim 13, wherein a dispatcher of the elevator group of the multiple elevator groups with the highest favorability score is configured to determine the best elevator car of the elevator group of the multiple elevator groups with the highest favorability score to answer the elevator call.

15. The building elevator system of claim 12, wherein obtaining a favorability score from multiple elevator groups of the building elevator system further comprises:

transmitting to a dispatcher of each elevator group a favorability score query in response to the elevator call; and receiving a favorability score from each elevator group in response the favorability score query and the elevator call.

16. The building elevator system of claim 13, wherein the operations further comprise:

displaying the best elevator car on the destination entry device.

17. The building elevator system of claim 12, wherein the multiple elevator groups comprises a first elevator group serving a first range of landings and a second elevator group serving a second range of landings, wherein the second range of landings includes at least one landing not included in the first range of landings.

18. The building elevator system of claim 17, wherein the multiple elevator groups further comprises a third elevator group serving a third range of landings, wherein the third range of landings includes at least one landing included in the first range of landings and at least one landing included in the second range of landings.

19. The building elevator system of claim 18, wherein the operations further comprise:

obtaining a best elevator car of the elevator group of the multiple elevator groups with the highest favorability score to answer the elevator call.

20. The building elevator system of claim 19, wherein a dispatcher of the elevator group of the multiple elevator groups with the highest favorability score is configured to determine the best elevator car of the elevator group of the multiple elevator groups with the highest favorability score to answer the elevator call.

* * * * *